US011530902B2

(12) United States Patent
Klann et al.

(10) Patent No.: US 11,530,902 B2
(45) Date of Patent: Dec. 20, 2022

(54) COMPOSITE ENCLOSURE FOR EXPLOSIVE REACTIVE ARMOR AND METHODS OF MANUFACTURING THE SAME

(71) Applicant: Government of the United States, as represented by the Secretary of the Army, Washington, DC (US)

(72) Inventors: Shawn C. Klann, Warren, MI (US); Frederick C. Rickert, II, Royal Oak, MI (US); David B. Witherspoon, Port Huron, MI (US); William T. Hoffman, Howell, MI (US)

(73) Assignee: Government of the United Slates, as represented by the Secretary of the Army, Washington, DC (US)

( * ) Notice: Subject to any disclaimer, the term of this patent is extended or adjusted under 35 U.S.C. 154(b) by 20 days.

(21) Appl. No.: 17/376,563

(22) Filed: Jul. 15, 2021

(65) Prior Publication Data

US 2021/0341261 A1 Nov. 4, 2021

Related U.S. Application Data

(62) Division of application No. 15/910,139, filed on Mar. 2, 2018, now Pat. No. 11,067,368.

(60) Provisional application No. 62/442,499, filed on Jan. 5, 2017.

(51) Int. Cl.

| | |
|---|---|
| ***F41H 5/007*** | (2006.01) |
| ***F41H 5/013*** | (2006.01) |
| ***F41H 7/04*** | (2006.01) |

(52) U.S. Cl.
CPC ..... *F41H 5/007* (2013.01); *F41H 5/013* (2013.01); *F41H 7/04* (2013.01)

(58) Field of Classification Search
USPC ..... 428/73, 593
See application file for complete search history.

(56) References Cited

U.S. PATENT DOCUMENTS

| | | | | |
|---|---|---|---|---|
| 11,067,368 | B1 * | 7/2021 | Klann | F41H 5/007 |
| 2013/0219600 | A1 * | 8/2013 | Atorrasagasti | B32B 5/12 2/463 |

* cited by examiner

*Primary Examiner* — Lynda Salvatore
(74) *Attorney, Agent, or Firm* — Gregory P. Gibson

(57) ABSTRACT

An explosive reactive armor (ERA) enclosure for an ERA tile includes a bottom and a plurality of sidewalls extending from the bottom, where the plurality of sidewalls are continuous with each other and with the bottom so as to define an internal volume. The plurality of sidewalls are formed from a fiber-reinforced composite material having a plurality of plies of fiber sheet material. Additionally, a sidewall seam defined by abutting edges of the first ply is offset from a sidewall seam defined by abutting edges of the second ply. Methods of manufacturing ERA enclosures, including applying wrap layers and forming attachment structures for securing the fiber-reinforced composite ERA enclosure to an armor element, are also described. The composite enclosure is inexpensive and lightweight and improves the dynamic capabilities of armored vehicles using such ERA tiles.

20 Claims, 11 Drawing Sheets

COMPOSITE ENCLOSURE FOR EXPLOSIVE REACTIVE ARMOR AND METHODS OF MANUFACTURING THE SAME

CROSS-REFERENCE TO RELATED APPLICATIONS

This application is a division of co-pending U.S. patent application Ser. No. 15/910,139, filed on Mar. 2, 2018 by at least one common inventor, which claims the benefit of U.S. Provisional Patent Application Ser. No. 62/442,499, filed on Jan. 5, 2017 by at least one common inventor. Each of the aforementioned applications is incorporated by reference herein in its entirety.

GOVERNMENT INTEREST

The inventions described herein may be made, used, or licensed by or for the U.S. Government for U.S. Government purposes.

BACKGROUND OF THE INVENTION

Field of the Invention

The present invention relates to explosive reactive armor tiles and, more specifically, to an enclosure made of fiber composite material for such tiles and methods of manufacturing the same.

Description of the Background Art

Today's military vehicles face more lethal and advanced threats than ever before. Chemical energy (CE) threats (such as shaped charges and explosively-formed projectiles) have seen increased usage in recent operations. Defeat of high performing CE threats on vehicles has until recently required heavy armors. The use of explosives in armor designs (explosive reactive armor or ERA) has the potential to significantly increase armor efficiency and effectiveness. Considerable weight savings in an armor design is attainable with the use of explosives and armor plates. However, the introduction of explosives to a vehicle brings many integration challenges. The containment of the explosive area on a vehicle is extremely critical. Excessive reactive armor explosions can damage the vehicle or introduce vulnerabilities to the vehicle by causing armor attachments to fail.

Explosive reactive armor includes an enclosure for housing armor plates and explosive. An enclosure with the armor plates and explosive mounted inside is called a reactive armor tile. The enclosure is a critical part of the integrated reactive armor tile design. It must be able to protect the explosive and armor materials from environmental exposure and to minimize the impact of the blast pressure generated by a reactive armor detonation on tiles adjacent to the detonation. An improperly contained explosion could cause secondary explosions or dislodging of adjacent reactive armor tiles. This would result in a larger than desired damage area. Therefore, a well-designed enclosure will prevent excessive damage from occurring in adjacent tiles.

Current designs of reactive armor enclosures used on combat vehicles are constructed from stainless steel and are heavy. An example of an existing baseline design of a combat vehicle ERA enclosure is constructed from 1.59 mm to 4.76 mm (0.0625 in. to 0.1875 in) thick stainless steel and weighs approximately 10 kg (22 lbs.). Enclosures of this type can add up to 2700 kg (approx. 6,000 lbs.) or more of integration weight to a combat-class vehicle, depending on the vehicle size and armor coverage area. The enclosure, however, provides minimal protection to the vehicle, and is therefore considered parasitic weight. As vehicle size and performance expectations continually increase, a heightened awareness has been given to lightweight integration designs. The reactive armor enclosures are significant integration weight drivers requiring weight reduction efforts.

SUMMARY OF THE INVENTION

The present invention overcomes the problems associated with the prior art by providing a fiber-reinforced composite explosive reactive armor (ERA) enclosure for an ERA tile and methods of manufacturing the same. The ERA enclosure is lightweight but strong, and thus, enables an ERA tile constructed therefrom to function appropriately in response to a CE threat and withstand detonations from neighboring ERA tiles. The lightweight ERA tiles also improve the dynamics of the armored vehicle to which they are applied.

An explosive reactive armor (ERA) enclosure according to one embodiment of the invention includes a bottom and a plurality of sidewalls extending from the bottom. The plurality of sidewalls are continuous with each other and with the bottom so as to define an internal volume. The sidewalls are formed from a fiber-reinforced composite material having a plurality of plies of fiber sheet material, where each of the plies forms a portion of each of the sidewalls and defines a sidewall seam in one the plurality of sidewalls. Additionally, a first sidewall seam defined by abutting edges of a first ply of the plurality of plies is offset from a second sidewall seam defined by abutting edges of a second ply.

In a particular embodiment, the first sidewall seam is located in a first sidewall of the plurality of sidewalls, and the second sidewall seam is located in a second sidewall of the plurality of sidewalls. In one example, the first and second sidewall seams are located near the middle of the first and the second sidewalls, respectively. In the case of a third ply, a third sidewall seam defined by abutting edges of the third ply is also located in the first sidewall (e.g., in the middle).

In another particular embodiment, the plurality of sidewalls are formed from at least six plies, and sidewall seams of adjacent plies are located in non-adjacent sidewalls.

In still another particular embodiment, at least some of the plurality of sidewalls are free of sidewall seams.

In yet another particular embodiment, the bottom of the enclosure is also formed from the plurality of plies, and each of the sidewalls is formed continuously with at least a portion of the bottom.

The ERA enclosure can also include a plurality of attachment structures formed in at least one of the first and second sidewalls, where the plurality of attachment structures is configured to couple the ERA enclosure to an armor element. More specifically, the plurality of attachment structures comprises a plurality of apertures configured to engage a mounting bracket, which itself is configured to mount the ERA enclosure to an armored vehicle body. In another more specific example, the plurality of attachment structures includes a plurality of apertures configured to secure at least a portion of an ERA component within the internal volume of the ERA enclosure. Still more specifically, at least some of the plurality of sidewalls are free of attachment structures, and each of the plurality of sidewalls that is free of attachment structures is also free of sidewall seams.

Another explosive reactive armor (ERA) enclosure includes a bottom and a plurality of sidewalls extending from the bottom, and at least one attachment structure formed in one or more of the sidewalls, where the attachment structure is configured to couple the ERA enclosure to vehicle armor. Additionally, the sidewalls define an interior volume in combination with the bottom, the sidewalls are continuously formed with each other and with the bottom, and the bottom and the plurality of sidewalls are formed from a fiber-reinforced composite material.

A method of manufacturing an ERA enclosure includes laying a first layer of fiber sheet material over a generally prismatic mold, laying a second layer of fiber sheet material over the first layer, infusing the first and the second layers with a resin, curing the resin to form a fiber-reinforced composite ERA enclosure, separating the ERA enclosure from the mold, and forming at least one attachment structure in the ERA enclosure, where the attachment structure is configured to secure the ERA enclosure to an armor element. The ERA enclosure includes a bottom and a plurality of sidewalls extending from the bottom, which are continuous and define an internal volume.

In a particular method, the first and second layers are shaped and oriented such that a first seam between edges of the first layer is offset from a second seam between edges of the second layer. In a more particular method, the step of laying the first layer includes laying the first layer of the fiber sheet material over the mold such that the first seam is disposed adjacent a first sidewall of the mold, and the step of laying the second layer of fiber sheet material includes laying the second layer over the mold such that the second seam is disposed adjacent a second sidewall of the mold.

In another particular method, the step of infusing the first and the second layers with resin includes positioning a vacuum bag over the mold, the first layer, and the second layer and applying vacuum to the vacuum bag to draw resin into the vacuum bag and into the first and the second layers.

Still another particular method includes applying pressure to the first and second layers prior to the step of curing the resin. In one more specific method, the step of applying pressure includes placing at least one exterior mold over the first and second layers. Still more particularly, the step includes installing a plurality of exterior molds around the perimeter of the second layer and applying a clamping force to the exterior molds. In another more specific method, the step of applying pressure to the first and the second layers includes applying pressure to form at least a portion of the attachment structure. More particularly still, the at least one attachment structure includes at least one relief on an exterior of the ERA enclosure, where the relief is configured to seat a mounting bracket for coupling the ERA enclosure to a body of an armored vehicle.

In yet another particular method, the step of forming at least one attachment structure in the ERA enclosure comprises forming a plurality of apertures in at least one sidewall of the ERA enclosure. More specifically, the plurality of apertures can be configured to secure an ERA component within the internal volume. Additionally or alternatively, the plurality of apertures can be configured to secure at least one mounting bracket to the ERA enclosure, where the mounting bracket is configured to secure the ERA enclosure to an armored vehicle body.

Still another particular method further includes a step of securing at least one ERA component within the ERA enclosure.

BRIEF DESCRIPTION OF THE DRAWINGS

The present invention is described with respect to the following figures, wherein like reference numbers indicate substantially-similar elements.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention. In other instances, particulars of well-known components and manufacturing practices have been omitted to avoid unnecessarily obscuring the present invention.

Figure 1:
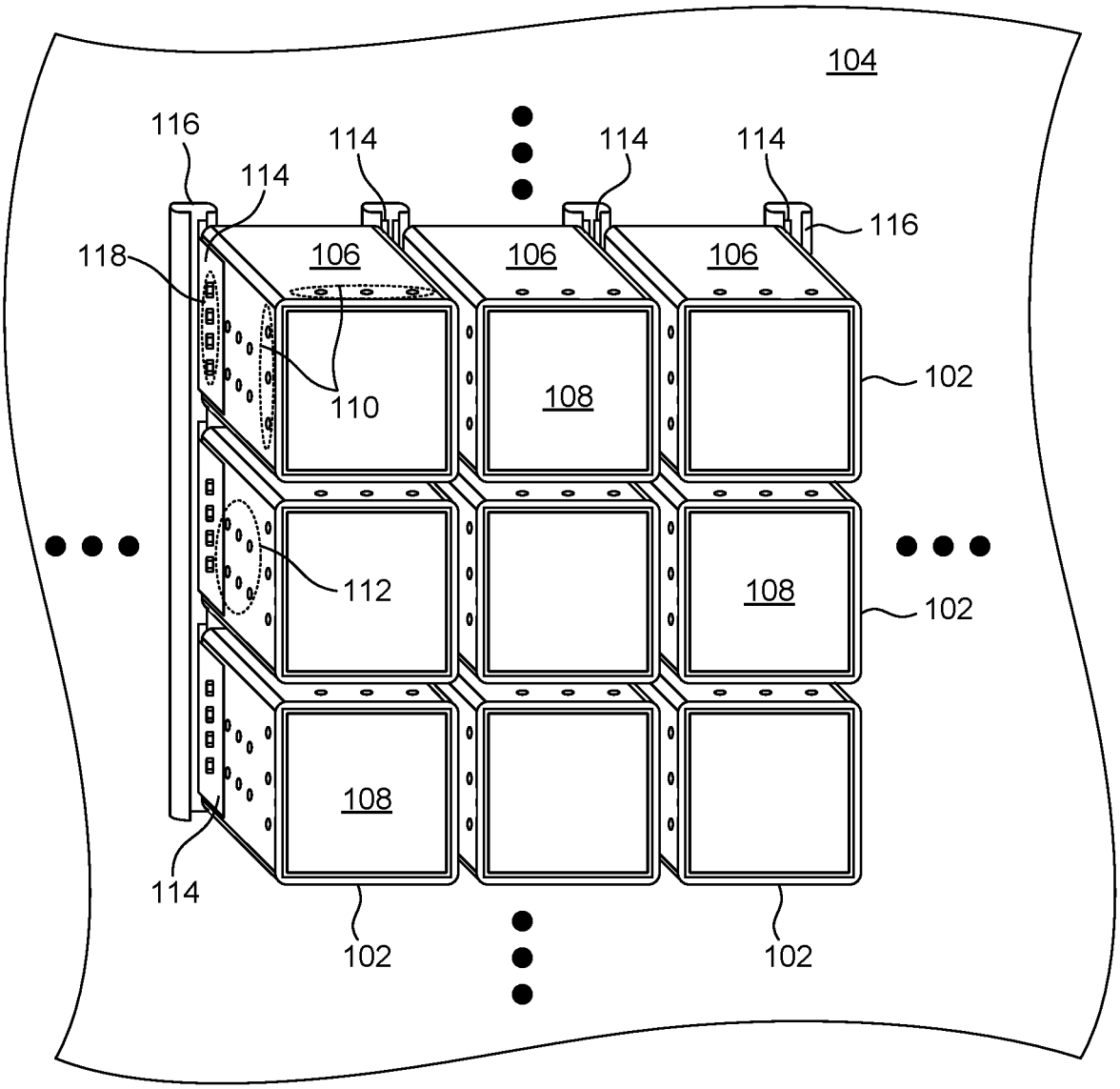
FIG. 1 is a perspective view showing fiber-reinforced composite explosive reactive armor (ERA) tiles according to the present invention mounted on an armored vehicle.

FIG. 1 is a perspective view showing a plurality of fiber-reinforced composite explosive reactive armor (ERA) tiles 102 mounted on the outside of an armored vehicle body 104 (e.g., a tank, personnel carrier, etc.). Nine ERA tiles 102 are shown mounted in a square (3×3) configuration. However, this configuration is merely exemplary, and ERA tiles 102 can be positioned differently according to vehicle and mission.

Each ERA tile 102 includes a fiber-reinforced composite enclosure 106 and a lid 108. The sidewalls and bottom (FIG. 3) of enclosure 106 define an interior volume (covered by lid 108) that houses explosive reactive armor components (e.g., armor plates, explosives, etc., not shown). First pluralities of fasteners 110 (e.g., rivets, threaded fasteners, etc.) are inserted through at least some of the sidewalls of each enclosure 106 to retain lid 108 thereon. Second pluralities of fasteners 112 (e.g., rivets, threaded fasteners, etc.) are also inserted through at least some of the sidewalls of enclosure 106 to mount and retain the ERA components therein.

FIG. 1 further shows that ERA tiles 102 are mounted to armored vehicle body 104 via mounting brackets 114 and mounting rails 116. Mounting rails 116 comprise "C" channels in this embodiment and are affixed (e.g., by fasteners, welding, etc.) to armored vehicle body 104. Each ERA tile 102 includes two mounting brackets 114 in this embodiment, which are positioned on opposing sidewalls of enclosure 106. Each mounting bracket 114 is affixed to a sidewall of its respective enclosure 106 by a plurality of fasteners 118. Mounting brackets 114 are "L" brackets, which extend past the bottom (back) of enclosure 106 and face inward relative to the enclosure 106, to be able to slide into (e.g., vertically) the "C" channels of mounting rails 116. While only the outside mounting brackets 114 of the left-most column of tiles 102 are shown in detail, the inside mounting brackets 114 are substantially similar thereto, but mirrored in orientation. Other means for mounting tiles 102 to armored body 104 are also possible.

In this embodiment, each enclosure 106 has interior dimensions of approximately 33 cm×33 cm×33 cm (13 in.×13 in.×13 in.) and is fabricated from a light-weight fiber composite material. These dimensions are only exemplary, however. For example, other reactive armor designs can utilize a shallower enclosure with a depth around 18 cm (approximately 7 inches). Examples of possible fiber materials used to construct enclosure 106 are fiberglass, aramid, and carbon. At appropriate wall thicknesses, the use of any of the three fibers provides significant weight savings in enclosure 106 over the prior art metal designs. However, harness satin weave or plain weave fiberglass fabrics of areal densities from 163 g/m$^2$ to 814 g/m$^2$ (4.8 oz/yd$^2$ to 24 oz/yd$^2$) have been found to provide particularly desirable enclosure characteristics as described below.

Figure 2A:
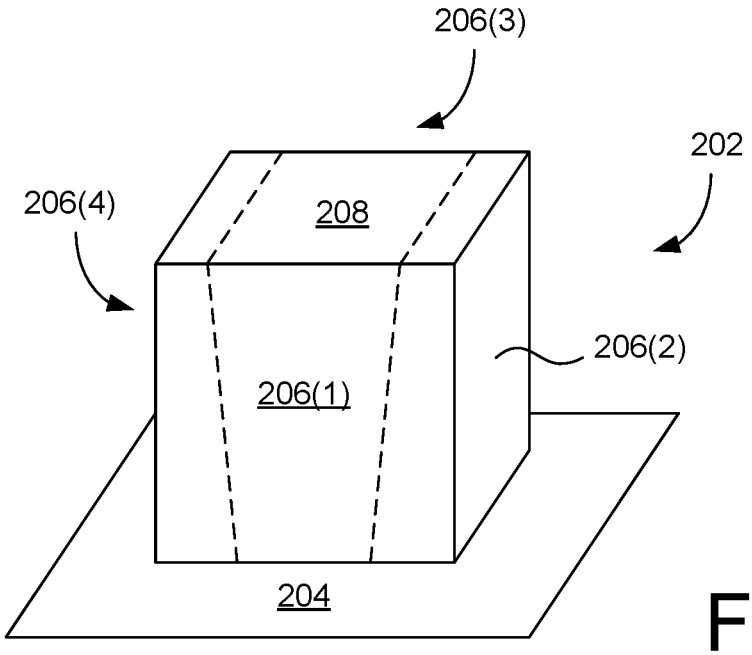
FIG. 2A is a perspective view showing a generally-prismatic mold used to manufacture a composite ERA enclosure of the present invention.

FIGS. 2A-2G graphically illustrate an exemplary method for manufacturing an ERA enclosure 106 according to the present invention. FIG. 2A is a perspective view of a generally-prismatic mold 202 positioned on a workbench 204. Mold 202 is cubic in this example and includes four sidewalls 206(1-4), and a top wall 208. Top wall 208 corresponds to the bottom of the completed enclosure 106, whereas sidewalls 206(1-4) correspond to the sidewalls of the completed enclosure 106. FIG. 2A shows the edges of mold 202 to be sharp for simplicity. However, it will be understood that such edges can be radiused to provide a smooth, arcuate transition between interior surfaces of the finished enclosure 106.

Mold 202 enables a plurality of plies of fiber sheet material to be sequentially laid up on it in the desired shape and then have resin infused (if necessary) and cured. Mold 202 is an interior mold in this example, meaning that the first ply applied to it will be the inner-most ply of the finished enclosure 106. An inner mold is desirable because it provides better control over the dimensions and surface finish of the interior of enclosure 106, thereby making fitting of the armor plates inside enclosure 106 easier and more uniform. Additionally, mold 202 is collapsible (separable) into three discrete sections along the dashed lines shown. The use of a collapsible mold 202 eliminates the need for a draft angle when removing the finished enclosure 106 therefrom. Mold 202 is formed from aluminum in this embodiment, although other materials (e.g., high-density foam, other metals, etc.) can be used instead.

Figure 2B:
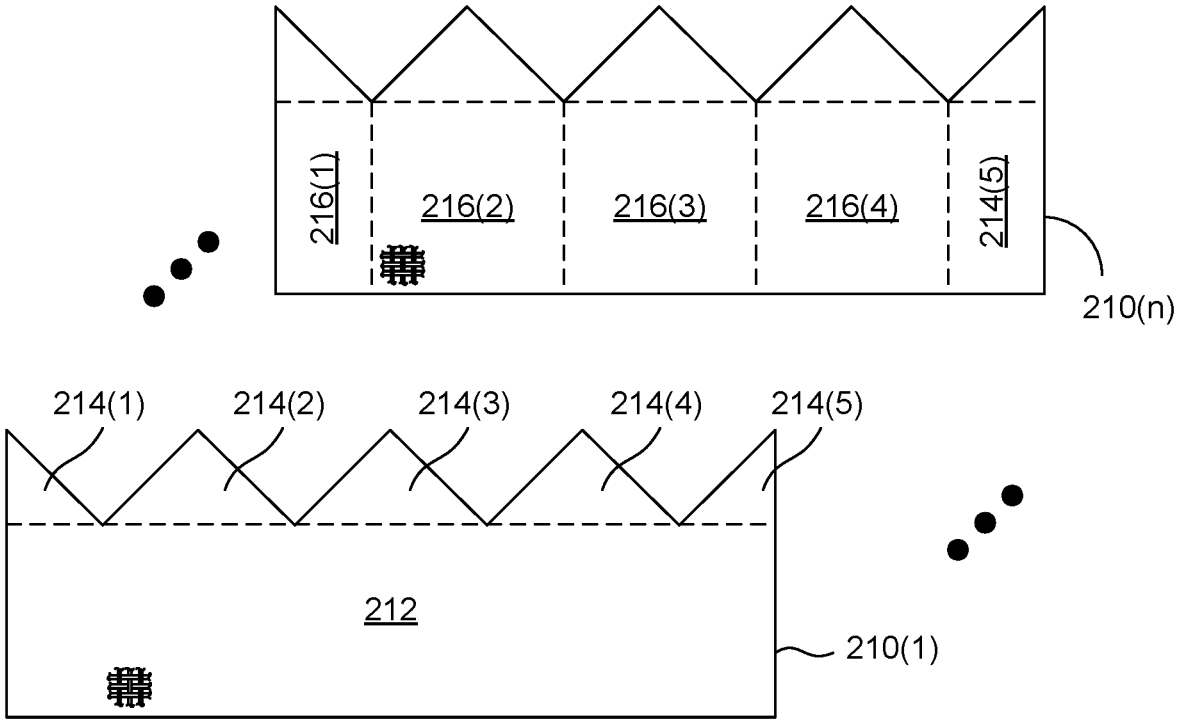
FIG. 2B shows a plurality of wrap layers according to the present invention for laying up on the mold of FIG. 2A.

FIG. 2B is a plan view showing a plurality of wrap layers 210(1-n) that will be laid up on mold 202. In this example, each wrap layer 210(1-n) has the same shape, but can vary in size to account for the volume added to the mold 202 by previously-applied wrap layers 210. In the present example, each enclosure 106 is formed from six wrap layers 210(1-6) of plain (cross) weave, 24 oz/yd$^2$ (814 g/m$^2$) S-2 fiberglass sheet material. The first three wrap layers 210(1-3) are all made in equal size. The last three wrap layers 210(4-6) are also made in equal size, but larger than the first three wrap layers, to account for the increased volume resulting from laying up the first three wrap layers 210(1-3) on mold 202.

As shown by the dashed line on wrap layer 210(1), each wrap layer 210(1-n) includes a generally rectangular section 212 formed continuously with five triangular flaps 214(1-5). Additionally, as shown on wrap layer 210(n), each wrap layer 210(1-n) is applied to mold 202 such that the regions 216(1-5) of section 212 will form sidewalls of a finished enclosure 106, and flaps 214(1-5) will combine to form the bottom of an enclosure 106. When a layer is laid up on mold, regions 216(1) and 216(5) abut and define a sidewall seam as described below.

Figure 2C:
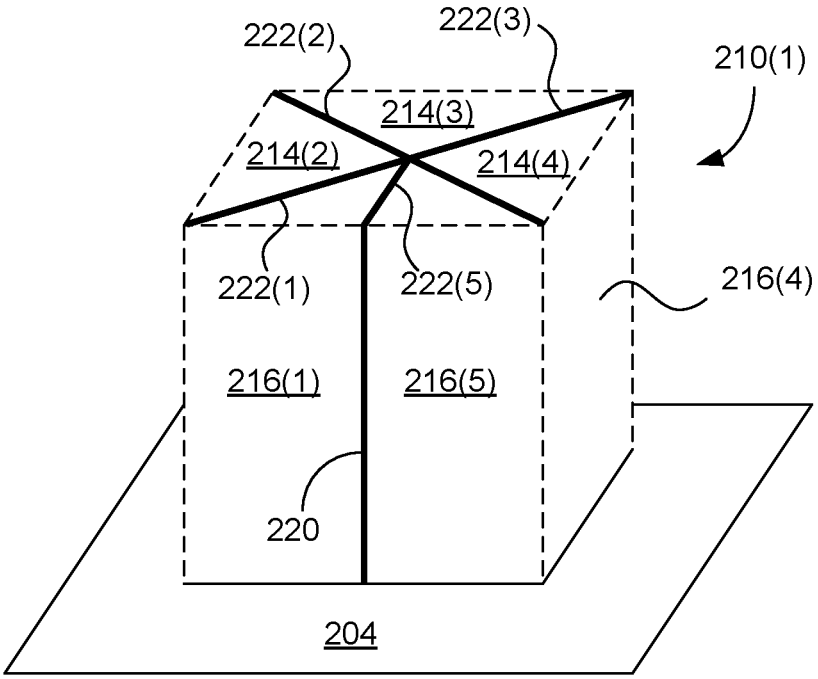
FIG. 2C is a perspective view showing a first wrap layer laid on the mold of FIG. 2A.

FIG. 2C is a perspective view showing first wrap layer 210(1) laid on mold 202 so that a sidewall seam 220 between rectangular regions 216(1) and 216(5) is positioned near the center of sidewall 206(1) (FIG. 2A) of mold 202. Sidewall seam 220 is formed by a direct abutment of the outside edges of regions 216(1) and 216(5). Accordingly, the seam 220 of wrap layer 210(1) will be away from corners of the completed enclosure 106 where high stress concentration are expected. FIG. 2C also shows that the flaps 214(1-5) of wrap layer 210(1) are folded over top wall 208 of mold 202 so as to form a bottom of enclosure 106 with five seams 222. Advantageously, the flaps 214(1-5) provide continuity between the sidewalls and the bottom of enclosure 106. Additionally, because there is only one sidewall seam 220, there is high fabric continuity in the sidewalls of the completed enclosure 106. Finally, the dashed lines denote bends/folds in continuous portions of fabric wrap layer 210(1) over the edges of underlying mold 202, but they are not seams.

To aid in applying wrap layer 210(1) to mold 202, a spray adhesive can be applied. For example, Super 77™ by 3M™ Corporation can be applied to temporarily hold wrap layer 210(1) in position on mold 202 and does not compromise the strength of the resin subsequently infused into the wrap layers 210. Use of Super 77™, however, is not required. Other spray adhesives can also be used.

Figure 2D:
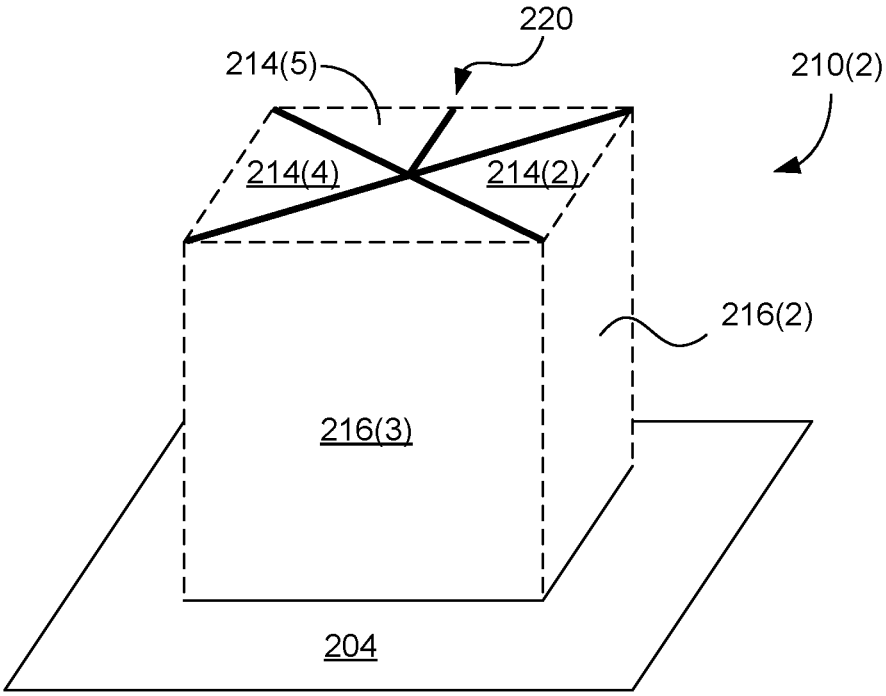
FIG. 2D is a perspective view showing a second wrap layer laid on the mold of FIG. 2A.

FIG. 2D shows a second wrap layer 210(2) laid up on mold 202 over first wrap layer 210(1). Second wrap layer 210(2) is laid up such that its sidewall seam 220 is offset from the sidewall seam 220 of first wrap layer 210(1). More specifically, sidewall seam 220 of second wrap layer 210(2) is positioned over back wall 206(2) of mold 202, i.e., opposite the sidewall seam 220 of the prior wrap layer. Flaps 214(1-5) of second wrap layer 210(2) are also folded down over top wall 208 of mold 202, which will form a second ply of the bottom of the completed enclosure 106. As before, a spray adhesive can be used to aid in the applique of second wrap layer 210(2) over first wrap layer (1).

The remaining wrap layers 210(3-6) are applied in alternation as illustrated in FIGS. 2C and 2D until mold 202 has all six plies laid up on it. That is, wrap layers 210(3) and 210(5) are applied to mold as illustrated in FIG. 2C, whereas wrap layers 210(4) and 210(6) are applied as shown in FIG.

2D. Thus, according to this example, only the front and back sidewalls 206(1) and 206(3) of mold 202 have sidewall seams 220 of wrap layers 210(1-6) adjacent thereto. This layering approach provides fiber continuity across the corners of adjacent sidewalls and across corners between the bottom and sidewalls of the completed enclosure 106 in each ply/layer.

Figure 2E:
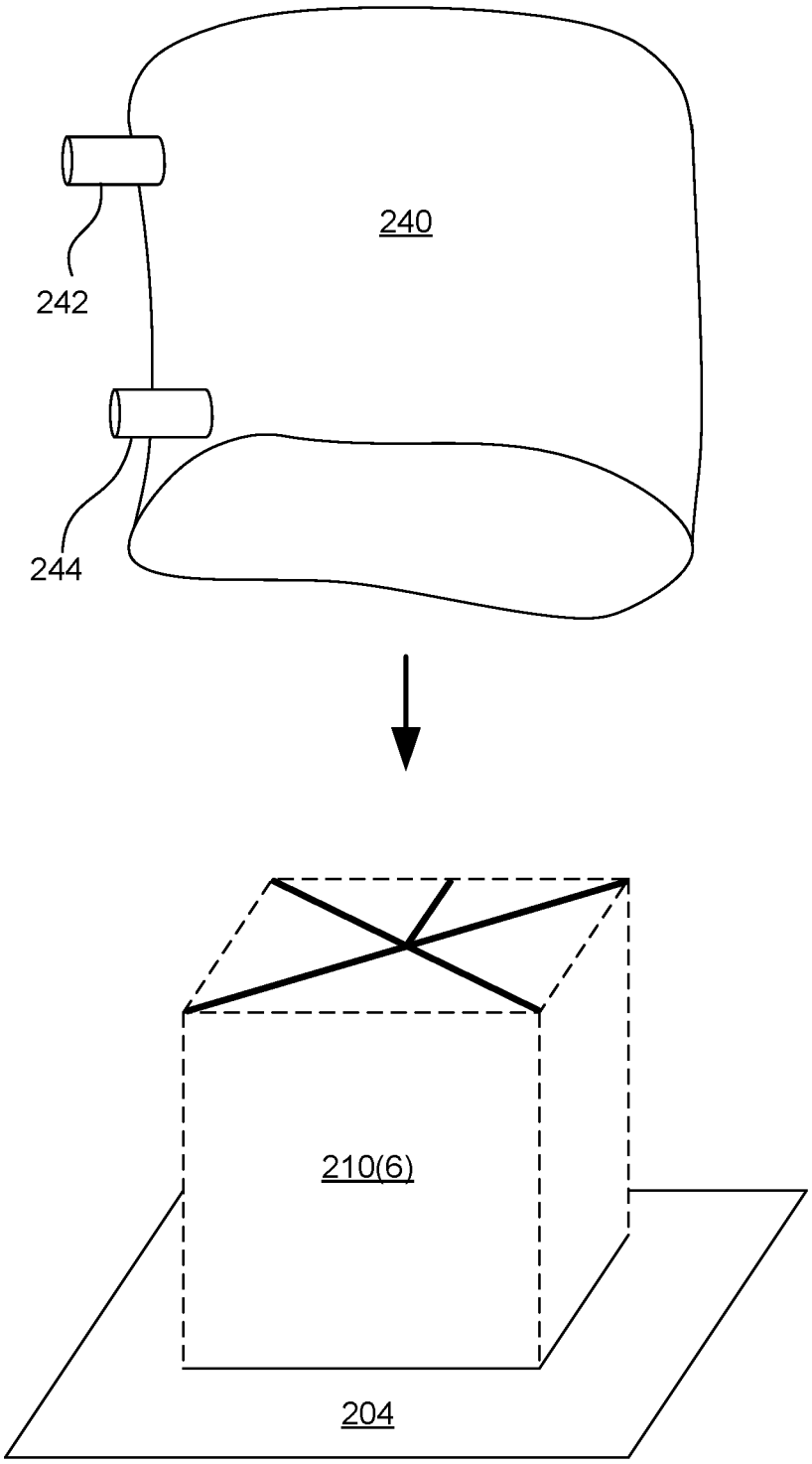
FIG. 2E is a perspective view showing the laid up mold of FIG. 2A being prepared for resin infusion by bagging.

FIG. 2E shows mold 202 having six wrap layers 210(1-6) applied thereto being prepared for resin infusion. An enclosure 240 (e.g., a vacuum bag, etc.) used for Vacuum Assisted Resin Transfer Molding (VARTM) is placed over mold 202 and/or workbench 204 and tightly secured (e.g., with tape, bands, etc.). Vacuum bag 240 includes a vacuum port 242 and a resin inlet port 244. When it is time to infuse the resin, vacuum is applied to port 242, which causes bag 240 shrink and conform to the laid-up mold 202, and pull resin into bag 240 via port 244. This, in turn, infuses the laid up wrap layers 210(1-6) with resin causes good "wet-out" of the wrap layers 210(1-6). Layers of peel ply and/or infusion media can also be applied between the outermost wrap layer 210(6) and the vacuum bag 240 to improve resin flow and to facilitate removal of the vacuum bag after cure. The VARTM process enables very consistent part manufacturing and also contributes to higher fiber volume fraction at low cost. Optionally, double bagging can be used to ensure uniform pressure on the part and clamping force on the exterior molds (discussed below).

Figure 2F:
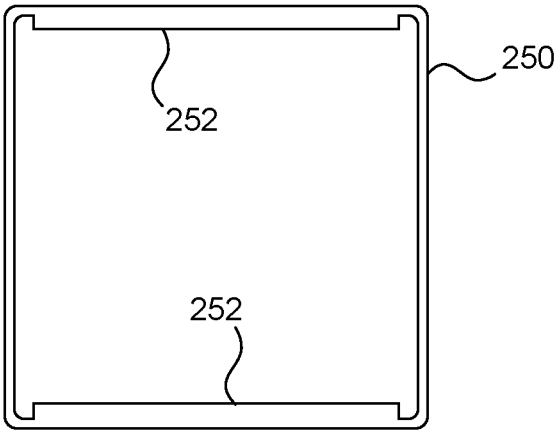
FIG. 2F is a bottom view of a bracket mold for applying over the bagged mold of FIG. 2E.

FIG. 2F is a bottom view of an external bracket mold 250, which is applied to the layup over top wall 208 of mold 202 and over vacuum bag 240. Bracket mold 250 includes protrusions 252 that form reliefs for mounting brackets 114 in the portions of wrap layers 210(1-6) adjacent mold sidewalls 206(1) and 206(3), which contain sidewall seams 220. Bracket mold 250 can be formed from a rigid material, such as a metal, high-density foam, etc.

Figure 2G:
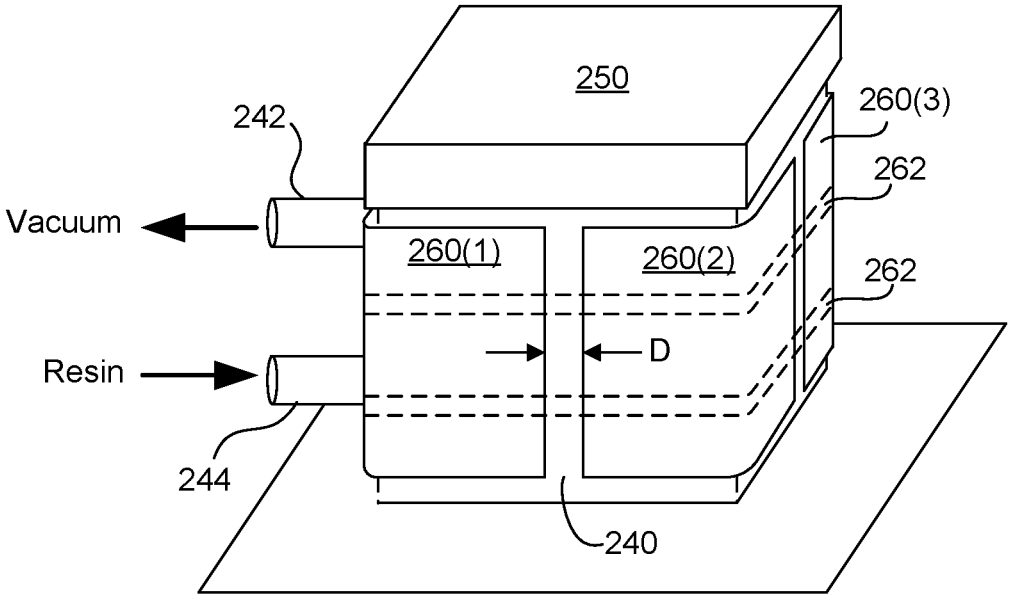
FIG. 2G is a perspective view showing exterior molds applied over the laid-up, bagged mold of FIG. 2E.

FIG. 2G shows additional exterior molds 260 applied around the perimeter of mold 202 over vacuum bag 240. Four exterior molds 260(1-4) are applied, each wrapping around a respective corner of the layup. In this embodiment, exterior molds 260(1-4) comprise four angle-brackets or caps made of rigid material, such as steel. Molds 260(1-4) are clamped down circumferentially around mold 202 until a distance D between adjacent external molds 260(1-2) reaches a predetermined value. Molds 260(1-4) can be clamped down using, for example, C-clamps (not shown) installed between adjacent pairs of molds 260(1-2), 260(2-3), 260(3-4), and 260(4-1). High-strength tape 262 can be used to hold the exterior molds 260 in position after they are clamped to the desired pressure.

The use of exterior molds 260, and bracket mold 250, provide two benefits: 1) increasing the fiber volume fraction; and 2) improving the exterior surface finish. For example, molds 260(1-4) are arcuate in the corners and, therefore, smooth and round the corners between the sidewalls of the finished enclosure 106. Similarly, mold 250 functions to smooth and round corners between adjacent sidewalls and between sidewalls and bottom of the finished enclosure 106. The gaps between molds 260(1-4) and mold 250 allow routing of ports 242 and 244 therethrough.

When the predetermined distance D is reached, then the laminated wrap layers 210(1-6) have been compressed to the desired aggregate wall thickness for enclosure 106 and resin can be infused (pulled) into the laid up wrap layers 210(1-n) via port 244 by applying vacuum to port 242. The inventors have found that epoxy is a desirable resin choice because of its hardness and resistance to fracture. For example, the two-part epoxy "SC-15" by Applied Poleramic, Inc. of Benicia, Calif. can be used. However, use of epoxy resin is not a requirement and other types of resins can be used instead. The resin-infused wrap layers 210 are then cured according to the resin employed (e.g., by heating, etc.). The molds 202, 250, and 260(1-4) allow the fibers in wrap layers 210 to maintain shape while the resin cures.

After the resin has cured sufficiently to retain its shape, the resulting fiber-reinforced composite enclosure 106 is separated from molds 250 and 260(1-4), removed from the vacuum bag 140, and separated from the mold 202. Various attachment structures, such as pluralities of apertures 110 and 112 and apertures for mounting brackets 114 can then be formed in the enclosure 106 (e.g., by drilling, water-jet, etc.). Thereafter, ERA components (e.g., armor plates, supporting components, etc.) can be placed inside of enclosure 106 and secured thereto along with lid 108 to complete the ERA tile 102.

Figure 3:
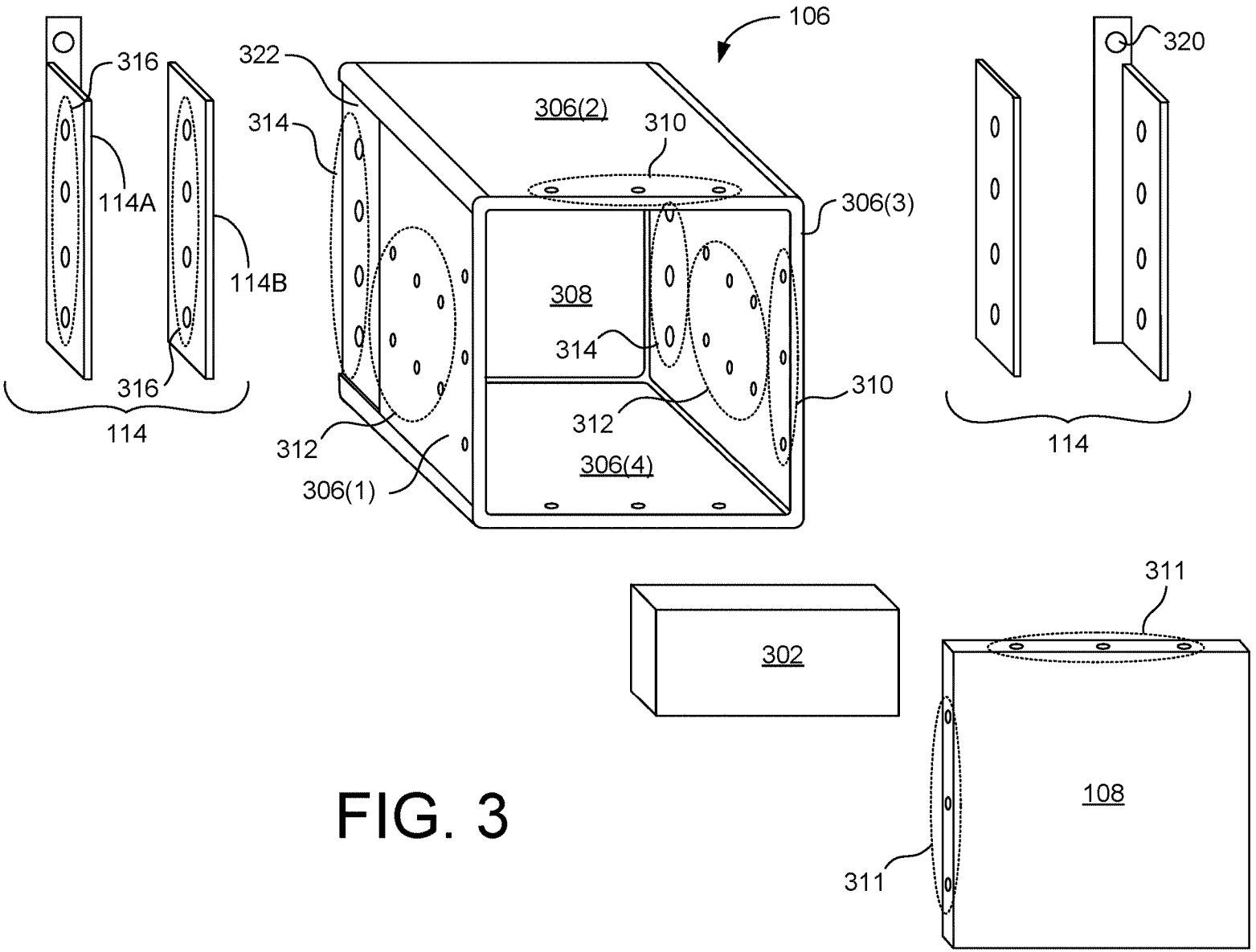
FIG. 3 is a perspective view showing a finished fiber-reinforced composite enclosure of the present invention and other elements of an ERA tile.

FIG. 3 shows a completed enclosure 106 ready to have, one or more ERA component(s) 302, two mounting brackets 114, and a lid 108 mounted thereto. Enclosure 106 includes four sidewalls 306(1-4) corresponding to sidewalls 206(1-4) of mold 202, respectively, and a bottom 308 corresponding to top wall 208 of mold 202. Sidewalls 306(1-4) and bottom 308 are formed continuously and have arcuate corners to reduce stress concentration there.

During finishing of enclosure 106, various pluralities of attachment structures are formed in its sidewalls 306. For example, a plurality of apertures 310 are formed in each sidewall 306 near the opening of enclosure 106. Apertures 310 align with complementary apertures 311 formed in a lip of lid 108 such that, after enclosure 106 is loaded with its ERA components 302, lid 108 is secured to enclosure 106 by fixing fasteners 110 through apertures 310 and 311. The inventors have found that using three rivets 110 per sidewall 306 is often sufficient to securely retains lid 108 in position even if a neighboring tile 102 detonates. However, additional or fewer fasteners can be employed if desired.

Second pluralities of apertures 312 are formed in sidewalls 306(1) and 306(3) such that fasteners 112 can be passed therethrough and into one or more ERA component (s) 302 (e.g., armor plates, etc.) to secure ERA component(s) 302 within enclosure 302. Because of this connection, ERA component(s) 302 provide significant structural reinforcement to enclosure 106 and resist flexing and inward deformation of sidewalls 306(1) and 306(3) when a neighboring tile 102 detonates. Apertures 312 can also comprise ports for inserting foam into enclosure 106. Expanding foam placed internally can also provide structural reinforcement to enclosure.

Third pluralities of apertures 314 are formed in sidewalls 306(1) and 306(3) as well. Apertures 314 are complementary to apertures 316 formed in mounting brackets 114 such that fasteners 118 (e.g., nuts and bolts, etc.) can be passed therethrough to secure mounting brackets 114 to enclosure 106. As shown, mounting bracket 114 includes an outer L-bracket 114A and a backing plate 114B. L-bracket 114A engages C-channels 116 (FIG. 1) and is secured to armored vehicle body 104 via fasteners passed through aperture(s) 320. The backing plate 114B is installed inside enclosure 106 and, in combination with L-bracket 114A, sandwiches the associated sidewall 306 therebetween. Accordingly, mounting brackets 114 structurally re-inforce sidewalls 306 (1) and 306(3).

Each of sidewalls 306(1) and 306(3) also includes a relief 322 (only relief for sidewall 306(1) shown), which seats L-bracket 114A generally flush with the outside of the respective sidewall. Relief 322 illustrates how the shape of the fiber composite enclosures 106 can be easily tailored in shape to accommodate the attachment provisions by making a geometric change to one or more external mold(s) 250 and/or 260.

Figure 4:
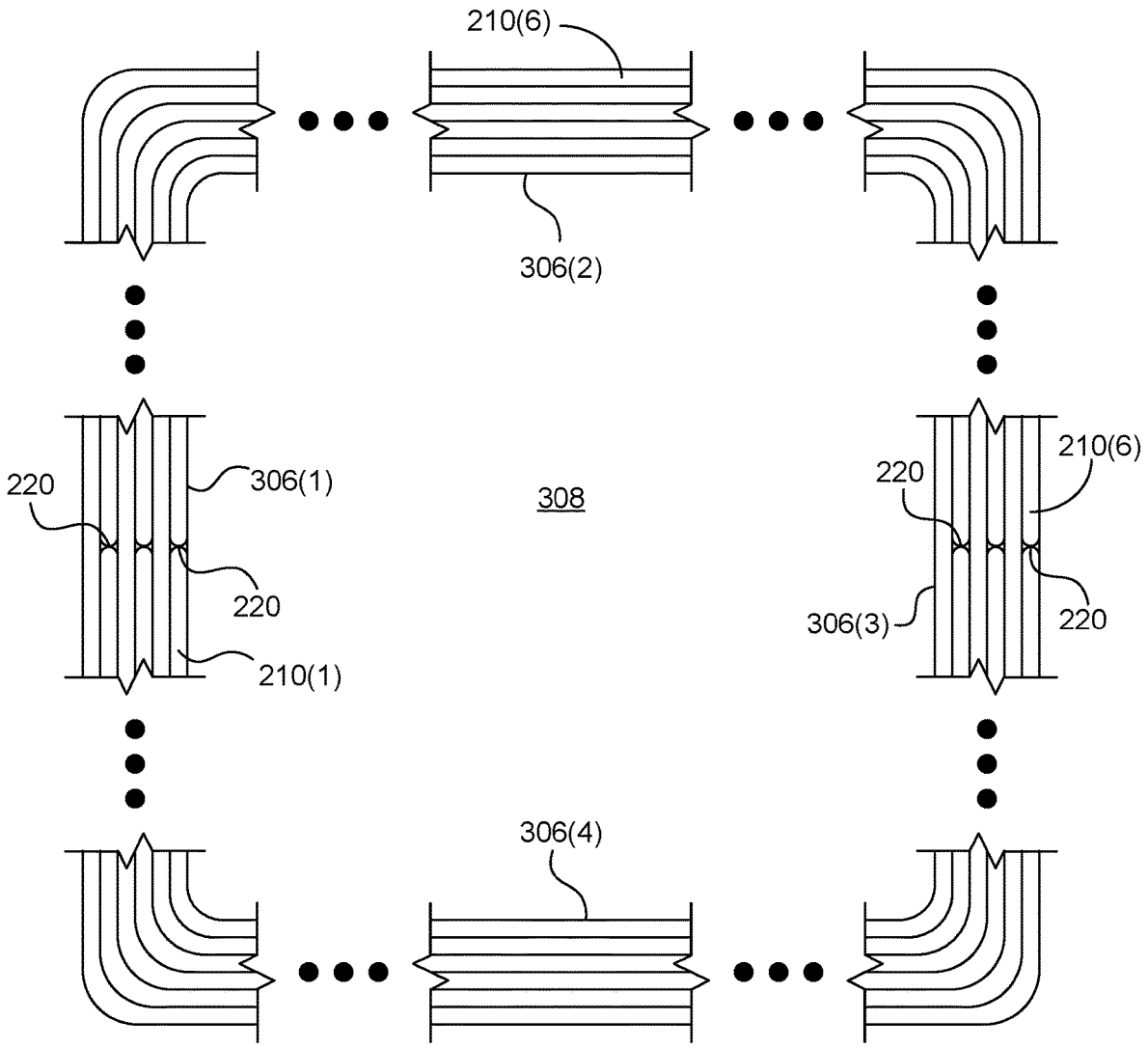
FIG. 4 is a view looking into the open end of enclosure.

FIG. 4 is a view of sidewalls 306(1-4) and bottom 308 looking into the open end of enclosure 106. As shown, sidewalls 306(1-4) and bottom 308 are formed continuously and are 6-ply. Only sidewalls 306(1) and 306(3) include sidewall seams 220. Additionally, sidewall seams 220 of adjacent plies are offset with respect to each other. More particularly, sidewall 306(1) contains sidewall seams 220 of odd-numbered wrap layers (starting with the innermost layer corresponding to wrap layer 210(1)), whereas sidewall 306(3) contains sidewall seams 220 of even-numbered wrap layers. Sidewalls 306(2) and 306(4) contain no sidewall seams 220.

The seam locations and armor attachment locations are selected to increase strength of the enclosure 106 in the hoop (perimeter) direction. For example, because sidewalls 306(2) and 306(4) contain no sidewalls seams 220 and are strong and flexible, they are resistant to inward inelastic deformation when a neighboring tile detonates. Additionally, when the ERA tile 102 including the enclosure 106 itself detonates, the sidewalls 306 flex outward before rupture. Their significant hoop strength (resistance to outward radial loading) absorbs much of the lateral blast energy before resin matrix breakdown and/or fiber breakage and, thus, limits damage to the neighboring tiles 102. Sidewalls 306(1) and 306(3) include several sidewall seams 220 each and, therefore, would be more susceptible to resin matrix breakdown during flexion. However, sidewalls 306(1) and 306(3) are structurally reinforced internally by the ERA component(s) 302 and internally and externally by the mounting brackets 114. Such reinforcement provides significant resistance to seam failure during neighboring tile detonations. Bottom 308 is also resistant to damage because it is mounted against armored vehicle body 104. Thus, the performance requirements of enclosure 106 are not degraded by the introduction of seams, particularly sidewall seams 220.

Of the three fiber sheet materials discussed herein (fiberglass, aramid, and carbon), testing has shown fiberglass to be the most efficient in terms of providing adequate blast protection for adjacent reactive tiles 102 at minimum weight. Carbon fiber enclosures were found to be quite brittle for the rapid blast loading of ERA. However, a combination of the materials may be used as well to achieve a balanced solution.

In testing, two enclosures were fabricated using heavier 814 g/m$^2$ (24 oz/yd$^2$) fiberglass fabric. The first enclosure had a wall thickness of 4.76 mm (0.1875 in.) and the second had a thickness of 3.18 mm (0.125 in). A third fiberglass enclosure was constructed utilizing 300 g/m2 (8.8 oz/yd$^2$) fabric sheets with a 4.76 mm wall thickness. The resulting enclosures weighed between 1.8 and 3.6 kg (approximately 4 and 8 lbs). These values are by way of example only and are not intended to be limiting.

Based on testing, it has been determined that enclosure 106 provides adequate blast protection from adjacent tiles with wall thicknesses as thin as 4.76 mm. Additionally, the 814 g/m$^2$ (24 oz/yd$^2$) fiberglass fabric sheet had better performance than the 300 g/m$^2$ (8.8 oz/yd$^2$) fiberglass fabric at this thickness. Because fewer wrap layers are needed with the heavier fabric, there is less reliance on resin matrix load transfer to resist damage and fracturing of the resin is reduced. Instead blast load is carried by tension in the heavier weight fibers.

Thus, the present invention provides fiber-reinforced composite enclosures for ERA tiles that are extremely lightweight compared to prior art steel enclosures, are able to resist detonations from neighboring tiles, and can be readily and inexpensively manufactured by VARTM without unique tooling. Accordingly, ERA tiles 102 can be provisioned for armored vehicles at lower cost, and because they are lightweight, the tiles 102 improve the dynamic loading and operability of such armored vehicles in theatre. Additionally, the composite enclosure 106 meets environmental testing requirements of MIL-STD 810.

Figure 5:
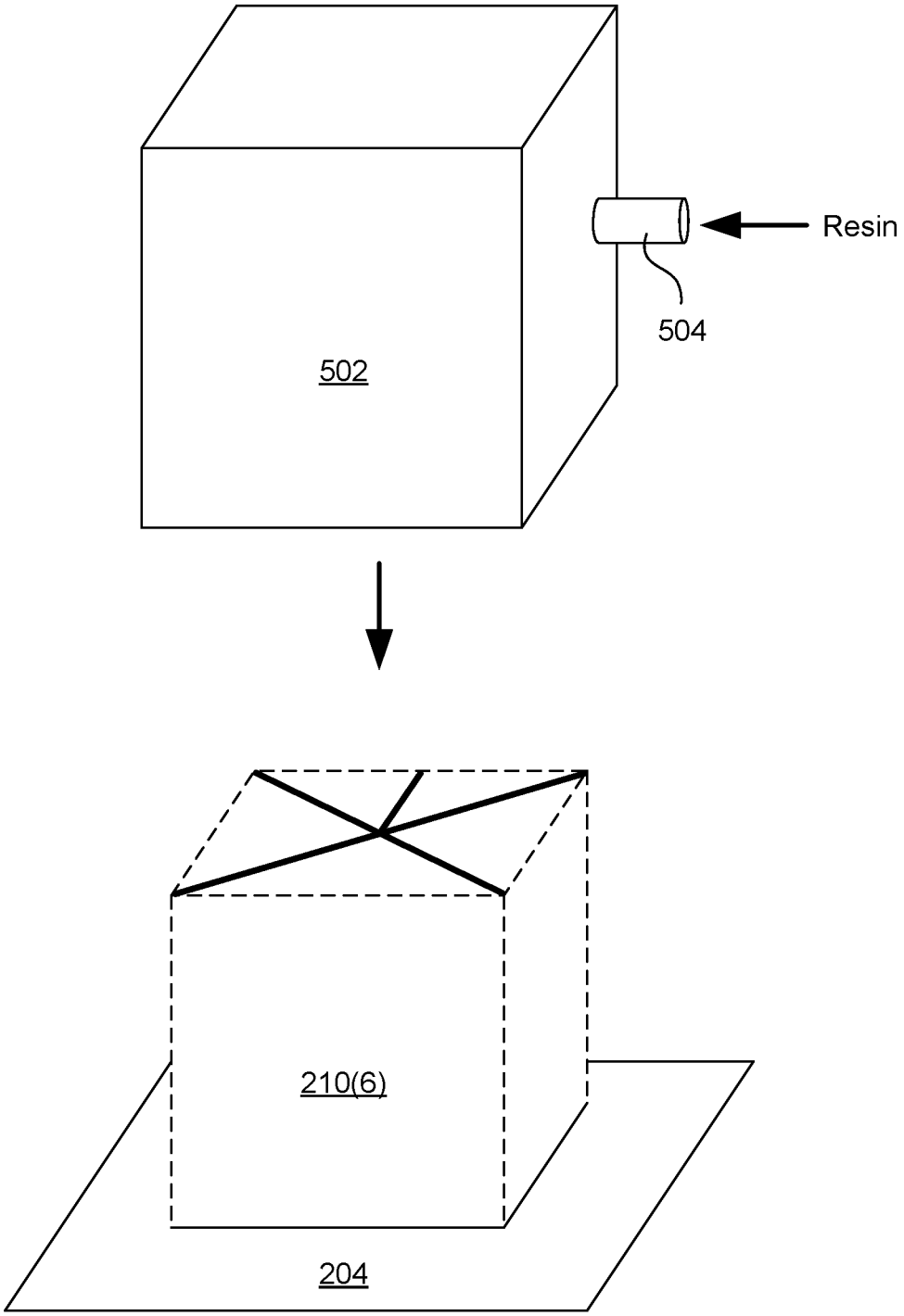
FIG. 5 is a perspective view illustrating a resin transfer molding (RTM) apparatus used to manufacture ERA enclosures according to an alternative method of the present invention.

FIG. 5 is a perspective view of an exterior mold 502 of a resin transfer molding (RTM) apparatus, which is used to infuse and cure the laid up mold 202 according to an alternative method of the invention. The interior cavity of exterior mold 502 defines a desired geometry for the external surface of enclosure 106. Exterior mold 502 is placed over laid up mold 202, and resin is pushed into the interstitial space between the two parts via inlet port 504. When the resin is cured (e.g., by heating), exterior mold 502 and mold 202 are separated from enclosure 106. RTM is often used in higher-production environments than VARTM and provides enclosures 106 with high quality bend radii (e.g., near the corners) and finish at a rapid throughput.

FIG. 5 illustrates how alterations can be made to the present invention without departing from its spirit and scope. Indeed, various alterations can be made. For example, pre-impregnated (pre-preg) fiber sheet material can be used. These pre-preg rolls of fabric contain the same fibers as described in previous embodiments, but already contain resin infused in the fiber. The use of pre-preg sheet material eliminates the need to infuse resin using the VARTM process. However, the desired number of layers can still be laid up on or in a mold, and then vacuum bagged to maintain the desired shape of the part during the curing process. This can be done with or without the use of external molds/brackets for maintaining shape.

As another option, pressure assisted curing (e.g., autoclave, etc.) can be utilized. For example, an autoclave provides uniform pressure around a part, in addition to heat, during curing, which provides a uniform exterior finish. Such uniform pressure can also be used to impart the desired external shape to the enclosure as an alternative, or in addition, to exterior molds.

As still another example, alternative wrap layers can be included in the enclosure. For example, one or more layer(s) in the shape of a "plus-sign" (+) can be laid up on mold 202 in addition to wrap layers 210. The plus-sign layer can be applied with its center over the top wall 208 (FIG. 2A) of mold 202 and its wings folded down over respective sidewalls 206. The plus sign layer can be used to provide reinforcement for the bottom 308 of the resulting enclosure, which would be beneficial where enclosure 106 was mounted to a vehicle via bottom 308.

As yet another example, wrap layers 210 can be formed from a fiber sheet material manufactured with more (or stronger) fibers located in the hoop (perimeter) direction of the resulting enclosure. Doing so can yield enclosures of adequate strength but that are lighter than other embodiments.

As still another example, composite enclosures can be manufactured using alternative molds and/or wrap layers of alternative shapes. For example, using an exterior mold in the shape of an open-top box, a first layer (which forms the outermost layer of the enclosure when removed from the exterior mold) is cut to a rectangle shape, placed in the mold, and wrapped around all four of the sides of the mold, leaving a seam along one of the wall/wall corners. A square piece of woven sheet is then placed in the bottom of the mold to create the bottom of the enclosure. An epoxy resin is then brushed onto the fibers. A second layer is cut in the shape of a "plus-sign" (+) and is placed in the bottom of the mold and folded up to create the sides. Again, resin is brushed onto the fibers. A third layer identical to the first layer is then laid up. This alternating pattern is continued until the desired total material thickness is achieved.

In yet another embodiment using an interior mold, a first layer of fiber sheet material is cut into the shape of a plus-sign and placed on the mold, and the sides folded down to create the walls. Resin is then brushed onto the fibers. A second layer in the shape of a rectangle is then wrapped around the side walls of the mold. Next, a square piece of woven sheet is placed on top of the mold to create the bottom of the enclosure. A third layer identical to the first layer is then applied over the second layer. This series of layers can be repeated until the desired total material thickness is achieved. A vacuum bag is then applied outside the mold to ensure proper/complete wet out of the fibers and shape conformity.

As still another example, the sidewall seams 220 of consecutive wrap layers 210 can be located in different sidewalls of enclosure 106 according to other schemes, such as in a predetermined order, clockwise, counterclockwise, etc. However, it is beneficial to limit the number, or eliminate, seams in sidewalls where there is no internal structural reinforcement. As yet another option, in any of the designs discussed herein, a strip of aramid fabric can also be added along one or more of the wall/wall corners and/or seams for added reinforcement. Similarly, other woven fabrics might be employed, such as ultra-high molecular weight polyethylene fibers such as available from Honeywell Spectra, Dyneema, etc. or an aramid fiber such as Kevlar™.

Figure 6:
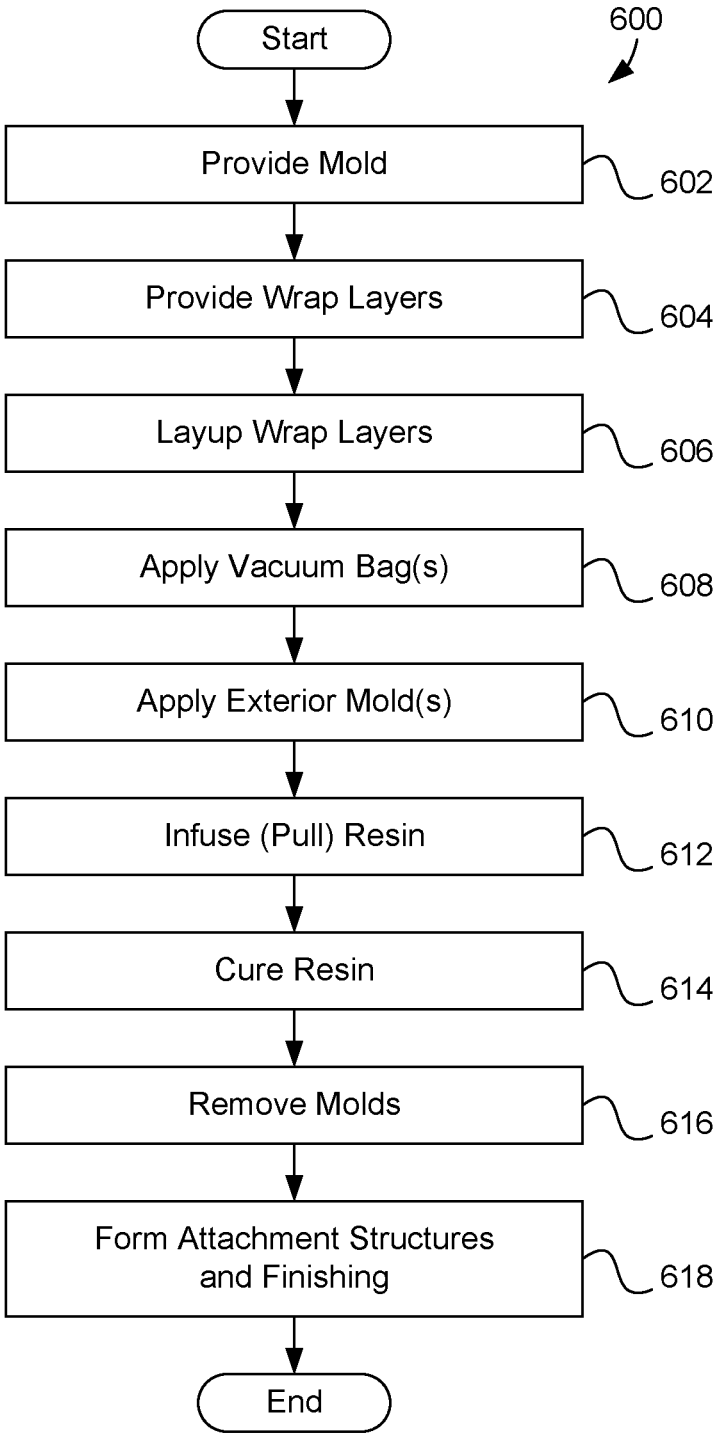
FIG. 6 is a flowchart summarizing one method for manufacturing an ERA enclosure of the present invention.

FIG. 6 is a flowchart summarizing one method 600 for manufacturing an ERA enclosure according to the present invention. In a first step 602, a mold is provided. In a second step 604, a plurality of wrap layers are provided, and in a third step 606, the wrap layers are laid up on the mold (e.g., so the sidewall seam of each layer is offset with respect to adjacent layers, etc.). In a fourth step 608, one or more vacuum bag(s) are applied over the laid-up mold, and in a fifth step 610, one or more exterior molds are applied over the vacuum bag(s). In a sixth step 612, vacuum is applied to the vacuum bag(s) to infuse (pull) resin into the laid-up wrap layers, and in a seventh step 614, the resin is cured, for example, by baking. Then, in an eighth step 616, the molds are removed from the enclosure. In a ninth step 618, attachment structures (e.g., for mounting brackets, ERA components, lids, etc.) are formed in the enclosure, and the enclosure undergoes finishing (e.g., deburring, painting with a chemical agent resistive coating, etc.). Optionally, sixth step 612 (infuse resin) can be avoided if pre-impregnated wrap layers are provided in second step 604.

Figure 7:
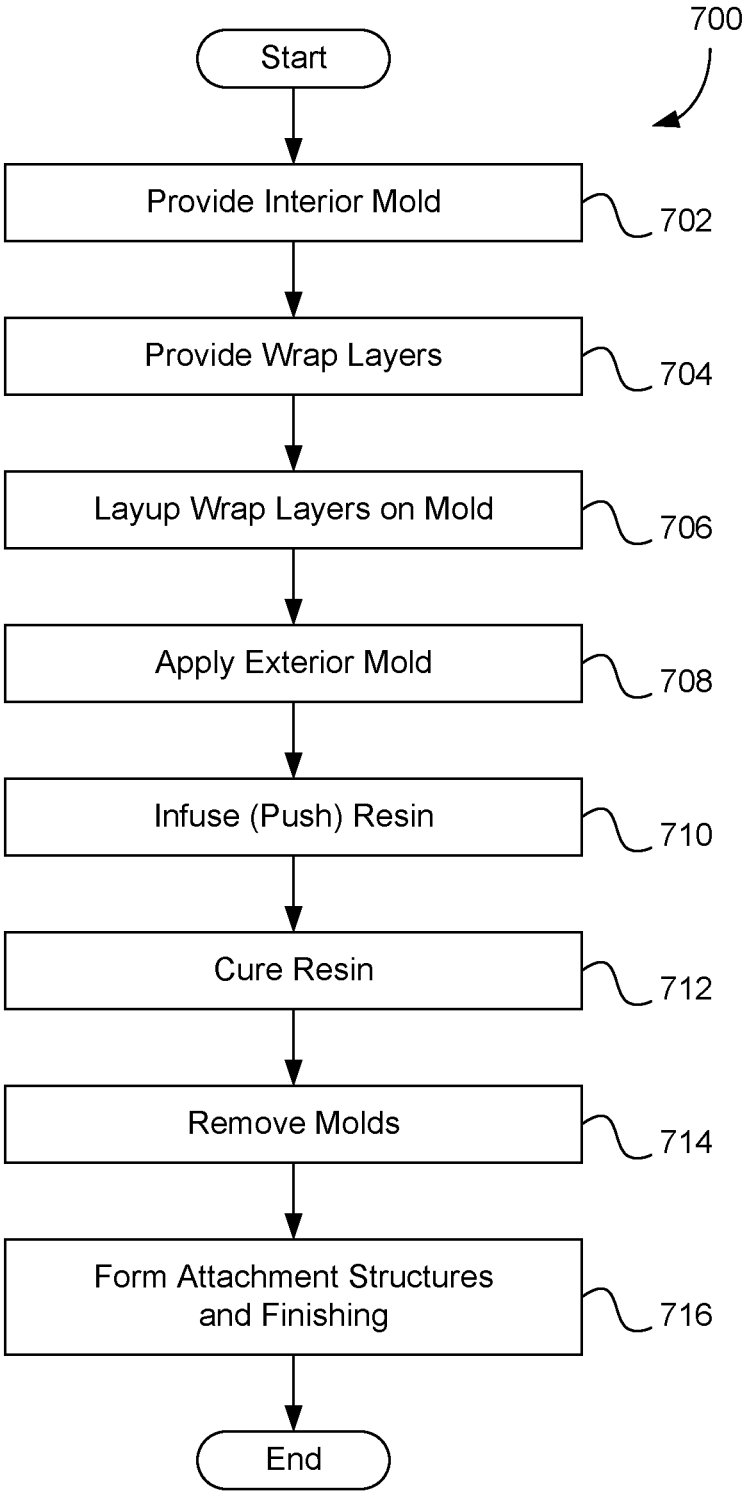
FIG. 7 is a flowchart summarizing another method for manufacturing an ERA enclosure of the present invention.

FIG. 7 is a flowchart summarizing another method 700 for manufacturing an ERA enclosure according to the present invention. In a first step 702, an interior mold is provided. In a second step 704, a plurality of wrap layers are provided, and in a third step 706, the wrap layers are laid up on the mold. In a fourth step 708, an exterior mold is applied over the laid-up interior mold. In a fifth step 710, resin is infused (pushed) into the interstices between the interior and exterior molds, and in a sixth step 712, the resin is cured. Then, in a seventh step 714, the molds are removed from the enclosure, and in an eighth step 716, attachment structures are formed in the enclosure, and the enclosure undergoes finishing as described above.

Figure 8:
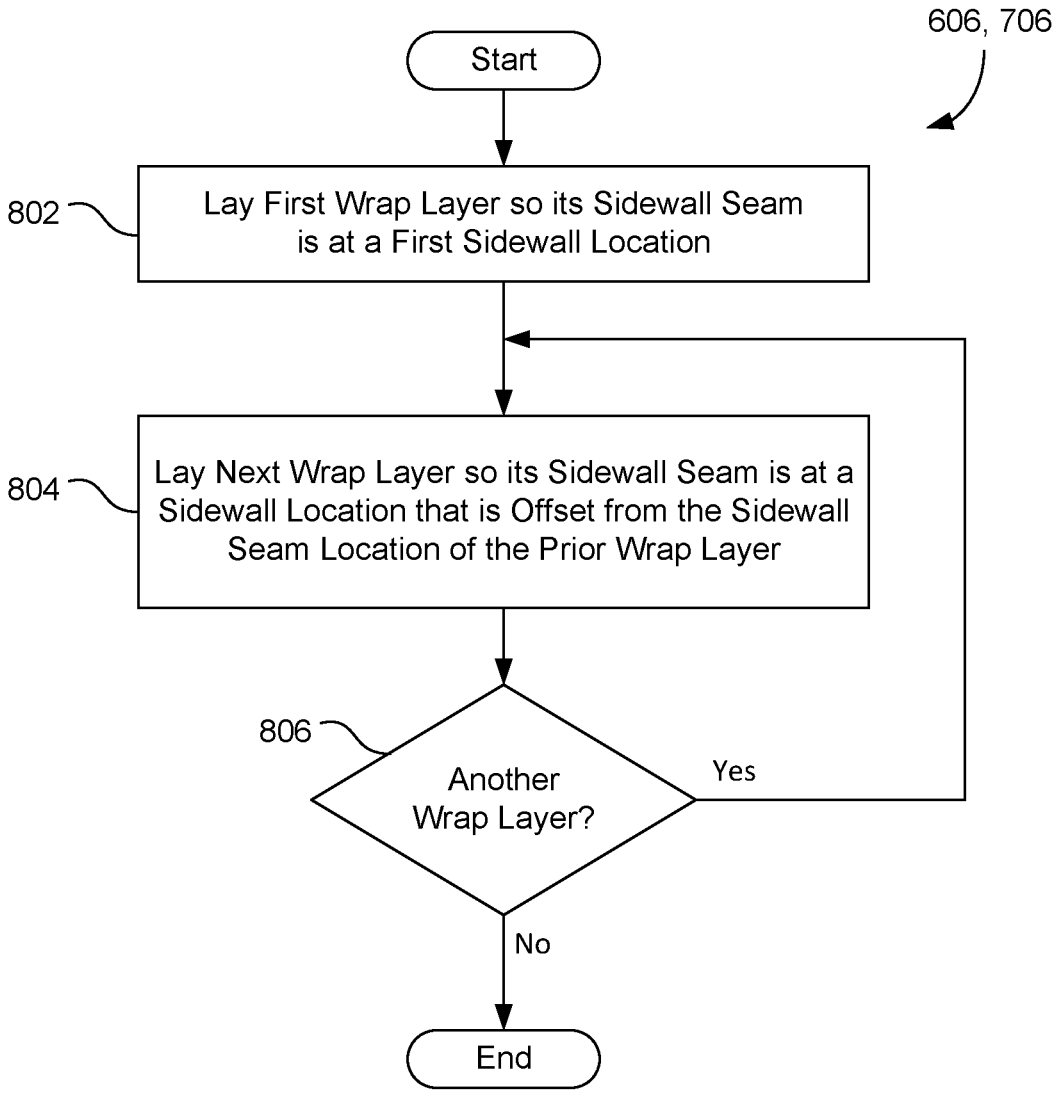
FIG. 8 is a flowchart summarizing a method for performing the third steps ("Layup Wrap Layers") of the methods of FIGS. 6 and 7.

FIG. 8 is a flowchart summarizing a method for performing the third steps 606 and 706 ("Layup Wrap Layers") of methods 600 and 700. In a first step 802, a first wrap layer is laid on the mold so that its sidewall seam is located in a first sidewall of the enclosure. In a second step 804, a second wrap layer is laid up so that its sidewall seam is at a location that is offset (e.g., in a different sidewall, etc.) from the sidewall seam location of the prior wrap layer. Then, in a third step 806, it is determined if there are more wrap layers to apply. If so, the method returns to second step 804. If not, then the method ends.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A method of manufacturing an explosive reactive armor (ERA) enclosure, said method comprising:

laying a first layer of fiber sheet material over a generally prismatic mold;

laying a second layer of fiber sheet material over said first layer;

infusing said first and said second layers with a resin;

curing said resin to form a fiber-reinforced composite ERA enclosure, said ERA enclosure including a bottom and a plurality of sidewalls extending from said bottom, said bottom and said plurality of sidewalls being continuous and defining an internal volume;

separating said ERA enclosure from said mold; and forming at least one attachment structure in said ERA enclosure.

2. The method of claim 1, wherein said first and said second layers are shaped and oriented such that a first seam between edges of said first layer is offset from a second seam between edges of said second layer.

3. The method of claim 2, wherein:

said step of laying said first layer includes laying said first layer of said fiber sheet material over said mold such that said first seam is disposed adjacent a first sidewall of said mold; and said step of laying said second layer includes laying said second layer of said fiber sheet material over said mold such that said second seam is disposed adjacent a second sidewall of said mold.

4. The method of claim 1, wherein said step of infusing said first and said second layers with said resin comprises:

positioning a vacuum bag over said mold, said first layer, and said second layer; and applying vacuum to said vacuum bag to draw said resin into said vacuum bag and into said first and said second layers.

5. The method of claim 1, further comprising applying pressure to said first and said second layers prior to said step of curing said resin.

6. The method of claim 5, wherein said step of applying pressure comprises placing at least one exterior mold over said first and said second layers.

7. The method of claim 6, wherein said step of placing said at least one exterior mold comprises:

installing a plurality of exterior molds around the perimeter of said second layer; and applying a clamping force to said exterior molds.

8. The method of claim 5, wherein said step of applying pressure to said first and said second layers comprises applying pressure to form at least a portion of said at least one attachment structure.

9. The method of claim 8, wherein said at least one attachment structure comprises at least one relief on an exterior of said ERA enclosure, said relief configured to seat a mounting bracket for coupling said ERA enclosure to a body of an armored vehicle.

10. The method of claim 1, wherein said step of forming at least one attachment structure in said ERA enclosure comprises forming a plurality of apertures in at least one sidewall of said ERA enclosure.

11. The method of claim 10, wherein said plurality of apertures is configured to secure an ERA component within said internal volume.

12. The method of claim 10, wherein said plurality of apertures are configured to secure at least one mounting bracket to said ERA enclosure, said mounting bracket configured to secure said ERA enclosure to an armored vehicle body.

13. The method of claim 1, further comprising securing at least one ERA component within said ERA enclosure.

14. The method of claim 1, further comprising providing a lid configured to removably engage said sidewalls and cover said internal volume.

15. The method of claim 1, wherein:

said step of laying said first layer of fiber sheet material over said generally prismatic mold comprises laying said first layer of fiber sheet material such that said first layer forms a portion of each of said sidewalls and abutting edges of said first layer define a first sidewall seam in a first one of said plurality of sidewalls; and said step of laying said second layer of fiber sheet material over said first layer comprises laying said second layer of fiber sheet material such that said second layer forms a portion of each of said sidewalls and abutting edges of said second layer define a second sidewall seam in a second one of said plurality of sidewalls.

16. The method of claim 15, wherein at least one of said plurality of sidewalls being free of any sidewall seams is located between said first and said second ones of said plurality of sidewalls.

17. The method of claim 16, further comprising:

laying a third layer of fiber sheet material over said second layer such that said third layer forms a portion of each of said sidewalls and abutting edges of said third layer define a third sidewall seam in said first one of said plurality of sidewalls; and wherein said step of infusing said first and said second layers with a resin further comprises infusing said third layer with resin.

18. The method of claim 15, wherein at least some of plurality of sidewalls of said ERA enclosure are free of any of said sidewall seams and said attachment structure.

19. The method of claim 18, wherein locations for said at least one said attachment structure and said sidewall seams are selected such that said plurality of sidewalls of said ERA enclosure resists inward inelastic deformation and outward radial loading.

20. A method of manufacturing an explosive reactive armor (ERA) enclosure, said method comprising:

laying a first layer of fiber sheet material over a generally prismatic mold such that said first layer forms each of a plurality of sidewalls and abutting edges of said first layer define a first sidewall seam in a first one of said plurality of sidewalls;

laying a second layer of fiber sheet material over said first layer such that said second layer forms a portion of each of said plurality of sidewalls and abutting edges of said second layer define a second sidewall seam in a second one of said plurality of sidewalls;

infusing said first and said second layers with a resin;

curing said resin to form a fiber-reinforced composite ERA enclosure, said ERA enclosure including a bottom and said plurality of sidewalls, said plurality of sidewalls extending from said bottom such that said bottom and said plurality of sidewalls are continuous and define an internal volume of said ERA enclosure; and separating said ERA enclosure from said mold.

* * * * *